US006544014B2

(12) United States Patent
Kobayashi

(10) Patent No.: US 6,544,014 B2
(45) Date of Patent: Apr. 8, 2003

(54) SCROLL-TYPE COMPRESSORS

(75) Inventor: Eiji Kobayashi, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/996,900

(22) Filed: Nov. 30, 2001

(65) Prior Publication Data

US 2002/0071778 A1 Jun. 13, 2002

(30) Foreign Application Priority Data

Dec. 8, 2000 (JP) ..... 2000-375166

(51) Int. Cl.[7] ..... F03C 2/00

(52) U.S. Cl. ..... 418/15; 418/55.1; 418/55.4; 524/495; 524/496

(58) Field of Search ..... 418/55.4, 55.1, 418/15; 524/496, 495

(56) References Cited

U.S. PATENT DOCUMENTS

| | | | | |
|---|---|---|---|---|
| 4,437,820 A | | 3/1984 | Terauchi et al. | |
| 4,453,899 A | | 6/1984 | Hiraga et al. | |
| 4,627,799 A | | 12/1986 | Terauchi | |
| 4,701,115 A | | 10/1987 | Shimizu et al. | |
| 4,722,676 A | | 2/1988 | Sugimoto | |
| 4,753,583 A | | 6/1988 | Hiraga et al. | |
| 5,124,397 A | * | 6/1992 | Kanazawa et al. | 524/495 |
| 5,575,634 A | * | 11/1996 | Tanaka et al. | 418/55.4 |
| 5,636,976 A | * | 6/1997 | Niwa et al. | 418/55.4 |
| 5,674,058 A | * | 10/1997 | Matsuda et al. | 418/15 |
| 6,126,422 A | * | 10/2000 | Crum et al. | 418/55.4 |

FOREIGN PATENT DOCUMENTS

| | | | | |
|---|---|---|---|---|
| JP | 62070681 A | * | 4/1987 | F04C/18/02 |
| JP | 62197684 A | * | 9/1987 | F04C/18/02 |
| JP | 08105391 A | * | 4/1996 | F04C/18/02 |

* cited by examiner

*Primary Examiner*—Thomas Denion
*Assistant Examiner*—Theresa Trieu
(74) *Attorney, Agent, or Firm*—Baker Botts L.L.P.

(57) ABSTRACT

A scroll-type compressor includes a fixed scroll member and an orbiting scroll member. The fixed scroll member has a first end plate and a spiral element formed on and extending from a first side of the first end plate. The orbiting scroll member has a second end plate and a spiral element formed on and extending from a first side of the second end plate. The spiral elements interfit with one other at an angular and radial offset to form a plurality of line contacts defining at least one pair of sealed-off, fluid pockets. A plurality of bypass apertures are formed through the first end plate of the fixed scroll member. A tip seal, which is made of Polyphenylene-sulfide or Polyetheretherketone, is embedded in a front end portion of the spiral element of the orbiting scroll member.

2 Claims, 4 Drawing Sheets

SCROLL-TYPE COMPRESSORS

BACKGROUND OF THE INVENTION

1. Field of the Invention

The present invention relates to scroll-type compressors.

2. Description of Related Art

A known scroll-type compressor includes a fixed scroll member and an orbiting scroll member within a housing. The fixed scroll member has a first end plate and a first spiral element that extends axially from the first end plate. The orbiting scroll member has a second end plate and a second spiral element that extends axially from the second end plate. The first spiral element and the second spiral element interfit at an angular and radial offset to form a plurality of line contacts that define at least one pair of sealed-off fluid pockets. The orbiting scroll member rotates in an orbital motion with respect to the fixed scroll member. The sealed-off fluid pockets move radially inward due to the orbital motion of the orbiting scroll member. The pockets also decrease in volume, thereby compressing refrigerant gas. A plurality of bypass apertures for discharging oil included in the refrigerant gas are formed through the first end plate of the fixed scroll member. A tip seal is embedded in a front end portion of the second spiral element of the orbiting scroll member. Various measures have been undertaken to reduce interference between the tip seal and the bypass apertures. These measures include modifications to those portions of the tip seal facing the bypass apertures. Examples of such known scroll-type compressors are disclosed in Japanese Unexamined Patent Application Publication No. H11-148472 and Japanese Utility Model Application Publication Nos. S61-17490 and S61-41882.

In the scroll-type compressor disclosed in Japanese Unexamined Patent Application Publication No. H11-148472, interference between a tip seal 100 and a plurality of bypass apertures is avoided by separating tip seal 100 into a plurality of segments, as shown in FIG. 1. Moreover, in the scroll-type compressor disclosed in Japanese Utility Model Application Publication No. S61-17490, an interference between a tip seal 100' and a plurality of bypass apertures is avoided by the provision of a plurality of concave portions 100'*a* formed on a front end of tip seal 100', as shown in FIGS. 2*a* and 2*b*, Moreover, in the scroll-type compressor disclosed in Japanese Utility Model Application Publication No. S61-41882, interference between tip seal 100" and a plurality of bypass apertures is avoided by the use of a plurality of notched portions 100"*b* formed on side walls of tip seal 100", as shown in FIGS. 3*a* and 3*b*. Thus, by avoiding interference between tip seal 100 (100' or 100") and the bypass apertures, wear of tip seal 100 (100' or 100") due to contact between tip seal 100 (100' or 100") and the bypass apertures may be reduced or eliminated. Accordingly, tip seal 100 (100' or 100") may be made of a polytetrafluoroethylene (PTFE) material, for example.

Nevertheless, in the scroll-type compressor of Japanese Unexamined Patent Application Publication No. H11-148472, in which the tip seal 100 at the front end portion of the second spiral element of the orbiting scroll member is separated into a plurality of segments, the manufacturing time required to form a groove that receives the segmented tip seal may increase. Moreover, additional manufacturing time may be required to embed segmented tip seal 100 in the front end portion of the second spiral element. Moreover, additional time may be required for inventory management of segmented tip seal 100 due to an increase in the number of parts of segmented tip seal 100. Further, tip seal 100 may be attached improperly. Additionally, performance of this scroll-type compressor may decrease due to refrigerant gas leaking through defective portions of tip seal 100, which portions may be caused by errors in the manufacture of tip seal 100. Similarly, in the scroll-type compressors of Japanese Utility Model Application Publication No. S61-17490 and Japanese Utility Model Application Publication No. S61-41882, the performance of these scroll-type compressors may decrease due to refrigerant gas leaking between fluid pockets via concave portions 100'*a* of tip seal 100' or notched portions 100"*b* of tip seal 100".

SUMMARY OF THE INVENTION

A need has arisen to simplify the manufacture of tip seals and reduce leakage in known scroll-type compressors with an end plate of a fixed scroll member having bypass apertures and a front end portion of a spiral element of an orbiting scroll having a tip seal.

In an embodiment of this invention, a scroll-type compressor comprises a housing, a fixed scroll member, an orbiting scroll member, a drive mechanism, and a rotation prevention mechanism. The housing has an outlet port and an inlet port. The fixed scroll member comprises a first end plate and a spiral element formed thereon. The spiral element extends from a first side of the first end plate. The fixed scroll member is attached to the housing. The orbiting scroll member comprises a second end plate and a spiral element formed thereon. The spiral element extends from the first side of the second end plate. The spiral elements interfit at an angular and a radial offset to form a plurality of line contacts that define at least one pair of sealed-off fluid pockets. The drive mechanism comprises a drive shaft that is rotatably supported by the housing. Rotation of the drive shaft effects an orbital motion of the orbiting scroll member to thereby change a volume of the fluid pockets. A rotation prevention mechanism prevents the orbiting scroll member from rotating. A plurality of bypass apertures are formed through the first end plate of the fixed scroll member. A tip seal made of Polyphenylene-sulfide or Polyetheretherketone is embedded in a front end portion of the spiral element of the orbiting scroll member.

Other objects, features, and advantages of embodiments of this invention will be apparent to, and understood by, persons of ordinary skill in the art from the following description of preferred embodiments with reference to the accompanying drawings.

BRIEF DESCRIPTION DRAWINGS

The present invention may be more readily understood with reference to the following drawings.

FIG. 1 is a front view of a tip seal used in a known scroll-type compressor.

FIG. 2*a* is a front view of a tip seal used in a known scroll-type compressor.

FIG. 2*b* is a cross-sectional view taken along line B—B of FIG. 2*a*.

FIG. 3*a* is a front view of a tip seal used in a known scroll-type compressor.

FIG. 3*b* is a cross-sectional view taken along line B—B of FIG. 3*a*.

DETAILED DESCRIPTION OF PREFERRED EMBODIMENTS

Figure 4:
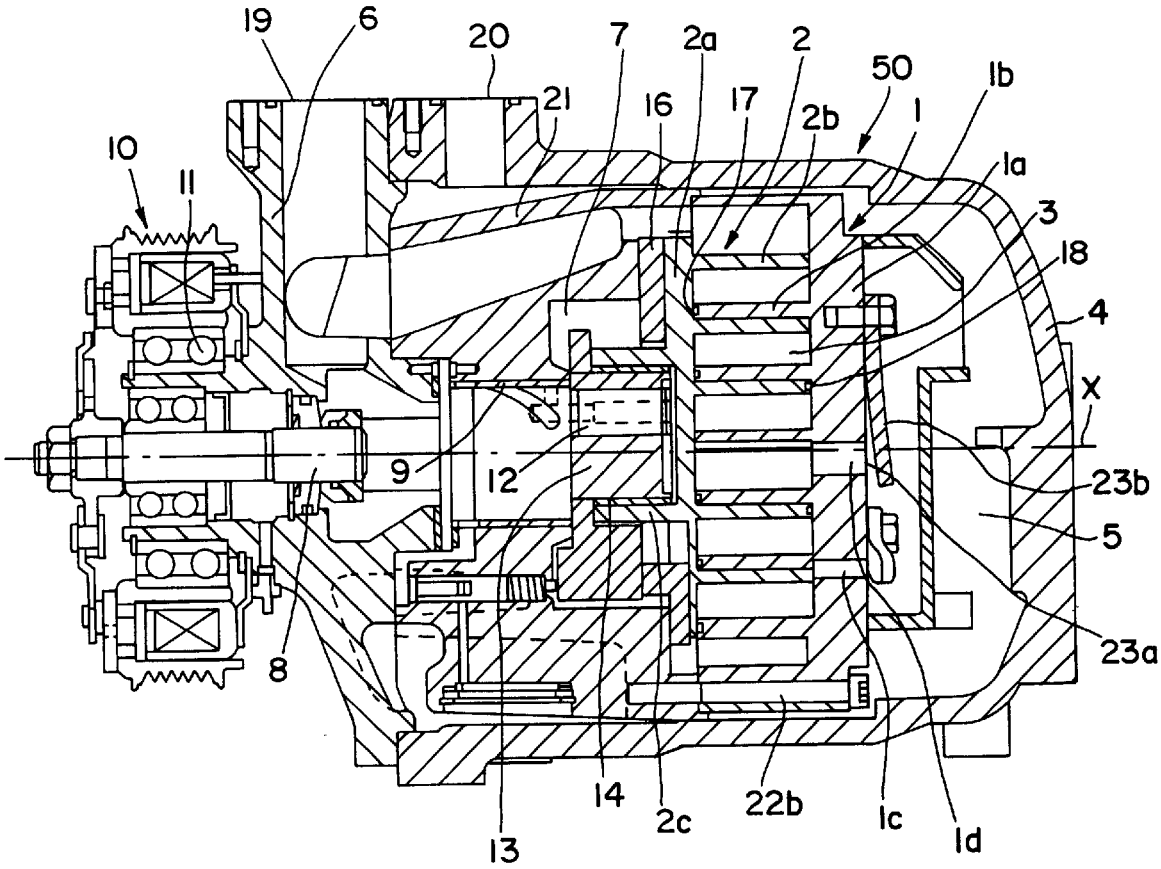
FIG. 4 is a longitudinal, cross-sectional view of a scroll-type compressor, according to an embodiment of the present invention.

Referring to FIG. 4, a scroll-type compressor according to an embodiment of the present invention is shown. A scroll-type compressor 50 has a fixed scroll member 1 and an orbiting scroll member 2 within a housing comprising a rear housing 4 and a front housing 6. Fixed scroll member 1 has a disc-shaped first end plate 1*a* and a first spiral element 1*b* extending from a first side of first end plate la. Orbiting scroll member 2 has a disc-shaped second end plate 2*a* and a second spiral element 2*b* extending from a first side of second end plate 2*a*. First spiral element 1*b* and second spiral element 2*b* are formed along an involute curve. First spiral element 1*b* of fixed scroll member 1 and second spiral element 2*b* of orbiting scroll member 2 are interfitted at an angular and radial offset to form a plurality of line contacts, which define at least one pair of sealed-off fluid pockets 3 between first spiral element 1*b* and second spiral element 2*b*. Rear housing 4 is fixed to front housing 6 by a plurality of bolts 22*a* to form a discharge chamber 5 at backside of fixed scroll member 1. A main housing 21 is fixed to fixed scroll member 1 by a plurality of bolts 22*b* to form a crank chamber 7 at a backside of orbiting scroll member 2.

A drive shaft 8 is disposed in front housing 6 and main housing 21 along an axial line X. One end of drive shaft 8 is rotatably supported by main housing 21 via a radial bearing 9. Another end of drive shaft 8 projects outwardly through front housing 6. An electromagnetic clutch 10, which is rotatably supported by front housing 6 via a radial bearing 11, connects to drive shaft 8. An eccentric pin 12 is fixed to another end of drive shaft 8 and projects in a direction parallel to the axis of drive shaft 8. Eccentric pin 12 is inserted into an eccentric bushing 13, which is rotatably disposed, via a radial bearing 14, in an annular boss 2*c* projecting from a second side of second end plate 2*a* of orbiting scroll member 2. A rotation prevention mechanism 16, which may be an Oldham coupling, is provided between the second side of second end plate 2*a* of orbiting scroll member 2 and an end surface of main housing 21. Rotation prevention mechanism 16 prevents the rotation of orbiting scroll member 2, but allows an orbital motion of orbiting scroll member 2 at a predetermined orbital radius with respect to the center of fixed scroll member 1.

Figure 1:
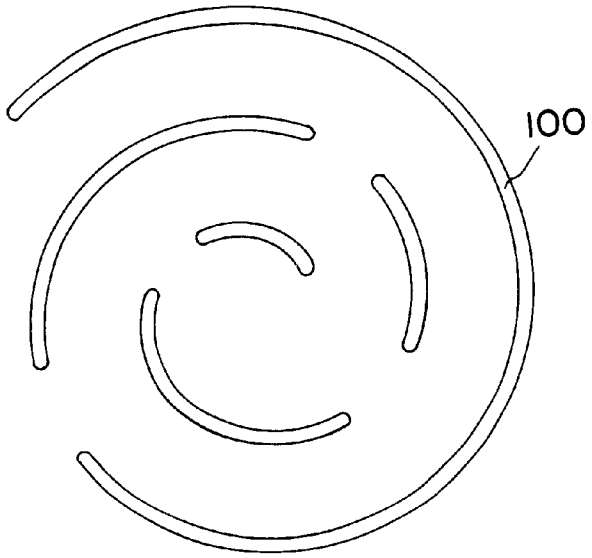
FIG. 1 PRIOR ART
Figure 2A:
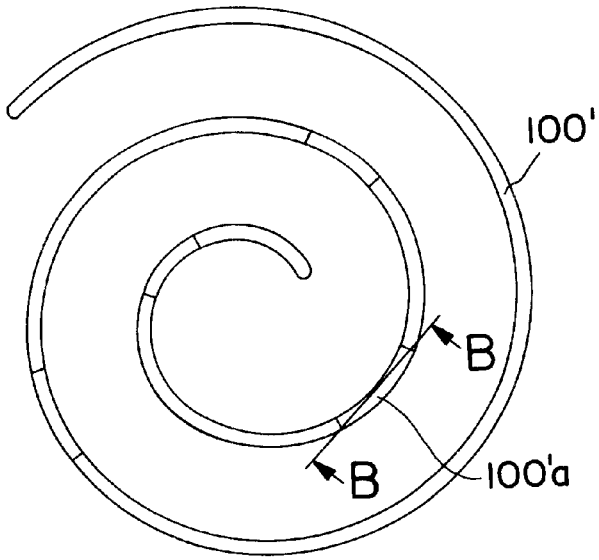
FIG. 2a PRIOR ART
Figure 2B:
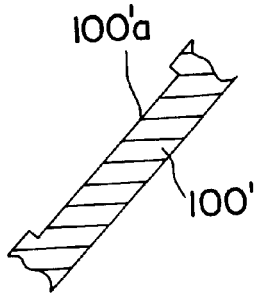
FIG. 2b PRIOR ART
Figure 3A:
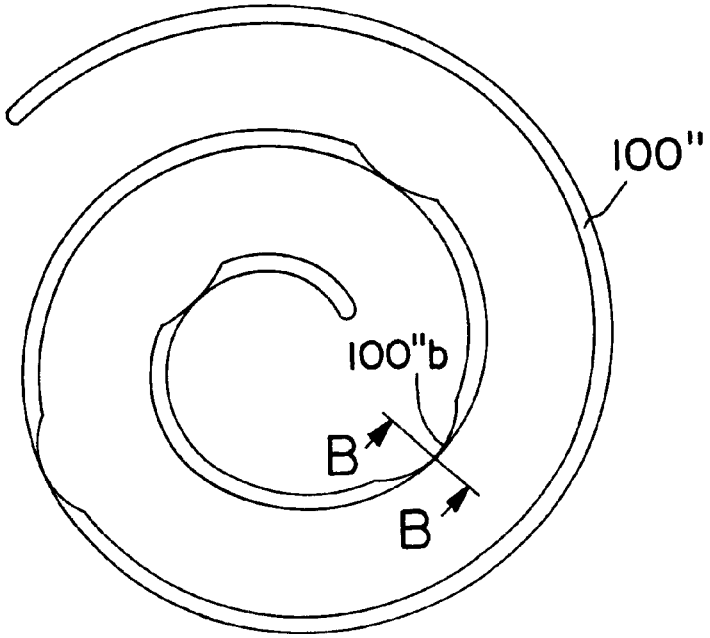
FIG. 3a PRIOR ART
Figure 3B:
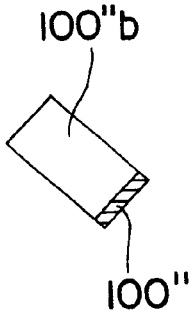
FIG. 3b PRIOR ART
Figure 5:
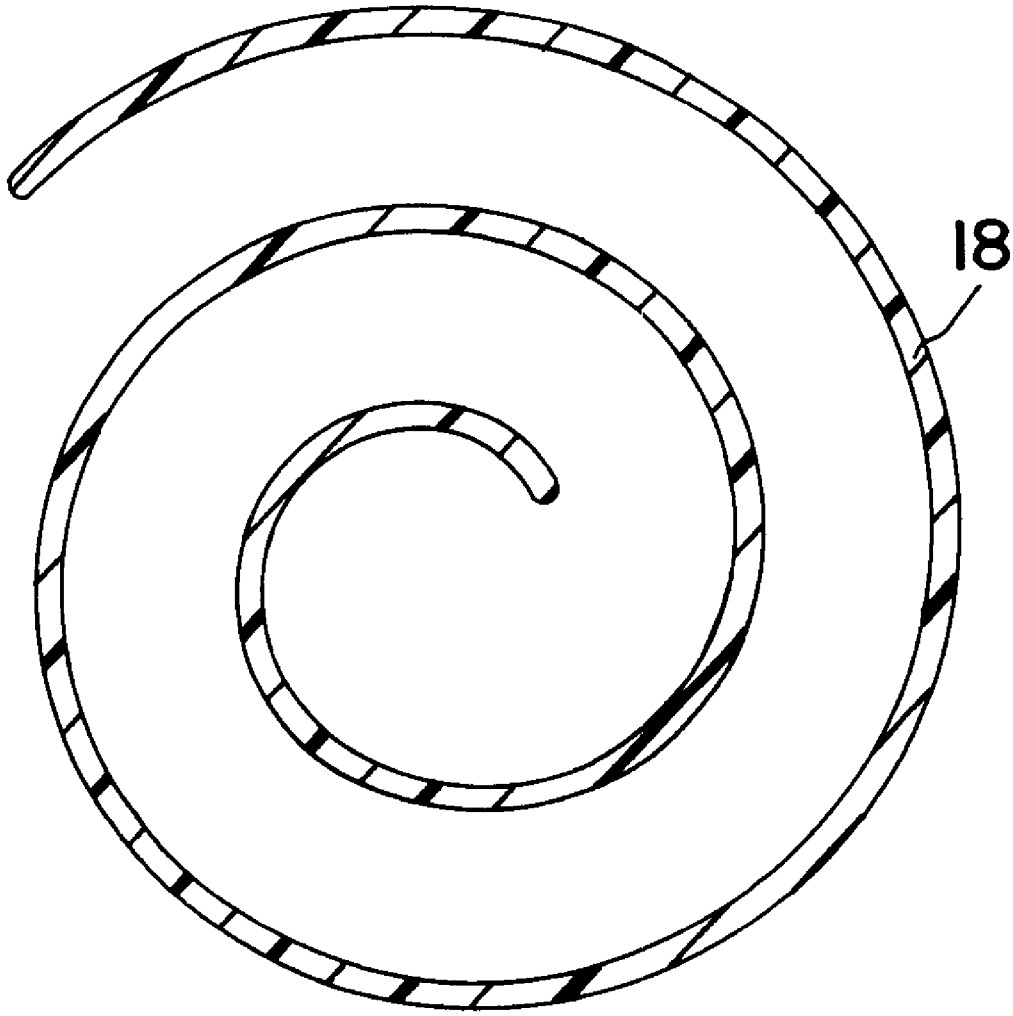
FIG. 5 is a front view of a tip seal used in the scroll-type compressor depicted in FIG. 4.

A plurality of bypass apertures 1*c* are formed through first end plate 1*a* of fixed scroll member 1 in order to communicate between fluid pockets 3 and discharge chamber 5. A first tip seal 17 is embedded in a front end portion of first spiral element 1*b*. A second tip seal 18 is embedded in a front end portion of second spiral element 2*b*. Second tip seal 18 may be made of Polyphenylene-sulfide (PPS) or Polyetheretherketone (PEEK). As shown in FIG. 5, second tip seal 18 has a continuous, involute curved shape. Second tip seal 18 is not segmented as is tip seal 100 of the known scroll-type compressor shown in FIG. 1. Concave portions are not formed on a front end of second tip seal 18. Moreover, notched portions are not formed on a side wall of tip seal 18.

In operation, when a driving force is transferred from an external driving source (e.g., an engine of a vehicle) (not shown) via electromagnetic clutch 10, drive shaft 8 is rotated. Orbiting scroll member 2, which is supported by eccentric pin 12, is driven in an orbital motion by the rotation of drive shaft 8. When orbiting scroll member 2 is driven in an orbital motion with respect to axial line X, fluid pockets 3 move from an outer or peripheral portion of the spiral elements to the center portion of the spiral elements. Refrigerant gas, which enters within compressor 50 through an inlet port 19 formed through front housing 6, flows into one of fluid pockets 3. As the fluid pockets 3 move from the outer portion of the spiral elements to the center portion of the spiral elements, the volume of the fluid pockets 3 is reduced, and refrigerant gas in the fluid pockets is compressed. Compressed refrigerant gas that is confined within the fluid pockets 3 moves through a discharge port 1*d* formed through a portion of first end plate 1*a* of fixed scroll member 1, near a center of first end plate 1*a*. The discharged gas displaces a reed valve 23*a* retained by a valve retainer 23*b*, and is discharged into discharge chamber 5. Finally, the compressed refrigerant gas is discharged into an external refrigerant circuit (not shown) through an outlet port 20 formed through rear housing 4.

As refrigerant gas in fluid pockets 3 moves towards a center portion of the spiral elements, lubricating oil present in the refrigerant gas may be discharged through the plurality of bypass apertures 1*c* into discharge chamber 5. As a result, compression of the lubricating oil may be reduced or eliminated. Thus, damage to vehicle components may be reduced or eliminated.

In scroll-type compressor 50, second tip seal 18 may be made of Polyphenylene-sulfide (PPS) or Polyetheretherketone (PEEK), each of which materials has a relatively high degree of hardness greater than a material such as polytetrafluoroethylene (PTFE), a material used for tip seals in known scroll-type compressors. Therefore, even if second tip seal 18 contacts an opening of one of bypass apertures 1*c*, wear of second tip seal 18 may be reduced or eliminated. Moreover, interference between second tip seal 18 and bypass apertures 1*c* need not be avoided in scroll-type compressor 50 of the present invention. Therefore, it is no longer necessary to segment second tip seal 18. Similarly, it is no longer necessary to form concave portions on a front end portion of second tip seal 18, or to form notched portions on a side wall of second tip seal 18. As a result, the problems encountered in the known scroll-type compressors may be avoided in the scroll-type compressor 50 of the present invention.

Although the present invention has been described in connection with preferred embodiments, the invention is not limited thereto. It will be understood by those skilled in the art that other embodiments, variations and modifications will be apparent to those skilled in the art from a consideration of this specification or practice of the invention disclosed herein, and may be made within the scope and spirit of this invention, as defined by the following claims.

What is claimed is:

1. A scroll-type compressor comprising:

a housing comprising an outlet port and an inlet port;

a fixed scroll member comprising a first end plate and a spiral element formed on and extending from a first side of said first end plate, said fixed scroll member being attached to said housing;

an orbiting scroll member comprising a second end plate and a spiral element formed on and extending from a first side of said second end plate, said spiral element of said orbiting scroll member interfitting with said spiral element of said fixed scroll member at an angular and a radial offset to form a plurality of line contacts defining at least one pair of sealed-off, fluid pockets;

a drive mechanism comprising a drive shaft rotatably supported by said housing to effect an orbital motion of said orbiting scroll member to thereby change a volume of said fluid pockets; and a rotation prevention mechanism preventing said orbiting scroll member from rotating, wherein a plurality of bypass apertures are formed through said first end plate of said fixed scroll member, and wherein a tip seal made of Polyetheretherketone is embedded in a front end portion of said spiral element of said orbiting scroll member.

2. A scroll-type compressor comprising:

a housing comprising an outlet port and an inlet port;

a fixed scroll member comprising a first end plate and a spiral element formed on and extending from a first side of said first end plate, said fixed scroll member being attached to said housing;

an orbiting scroll member comprising a second end plate and a spiral element formed on and extending from a first side of said second end plate, said spiral element of said orbiting scroll member interfitting with said spiral element of said fixed scroll member at an angular and a radial offset to form a plurality of line contacts defining at least one pair of sealed-off, fluid pockets;

a drive mechanism comprising a drive shaft rotatably supported by said housing to effect an orbital motion of said orbiting scroll member to thereby change a volume of said fluid pockets; and a rotation prevention mechanism preventing said orbiting scroll member from rotating, wherein a plurality of bypass apertures are formed through said first end plate of said fixed scroll member, and wherein a tip seal made of Polyphenylene-sulfide is embedded in a front end portion of said spiral element of said orbiting scroll member.

* * * * *